US007249441B2

(12) United States Patent
Hartle

(10) Patent No.: US 7,249,441 B2
(45) Date of Patent: Jul. 31, 2007

(54) POWER DRIVE UNIT FOR AUTOMOBILE WINDOWS

(76) Inventor: Charles Wayne Hartle, 4555 Aspen Hollow La., Salt Lake City, UT (US) 84117

( * ) Notice: Subject to any disclaimer, the term of this patent is extended or adjusted under 35 U.S.C. 154(b) by 190 days.

(21) Appl. No.: 11/004,741

(22) Filed: Dec. 6, 2004

(65) Prior Publication Data

US 2006/0119133 A1 Jun. 8, 2006

(51) Int. Cl.
*E05F 15/00* (2006.01)

(52) U.S. Cl. ..... 49/139; 49/140; 74/625

(58) Field of Classification Search ..... 49/139, 49/140; 74/625

See application file for complete search history.

(56) References Cited

U.S. PATENT DOCUMENTS 3,203,690 A * 8/1965 Werner ..... 74/670
4,553,656 A * 11/1985 Lense ..... 192/142 R
4,895,048 A * 1/1990 Key et al. ..... 74/625
5,329,163 A * 7/1994 Satoh et al. ..... 307/10.1
5,708,340 A * 1/1998 Chang ..... 318/480

* cited by examiner

*Primary Examiner*—Jerry Redman

(57) ABSTRACT

A power unit to replace the manual crank handle of a vehicle window, including a housing for a drive unit that will connect to the splined shaft from which a crank handle has been removed, the power unit including drive means to be affixed to a vehicle door when the drive means is coupled between a splined output shaft of the drive means and a splined shaft connected to operate the window; the housing having an exterior face plate and a surrounding wall with each having an exterior decorative finish and with a control switch for the motor projecting through the housing.

5 Claims, 4 Drawing Sheets

POWER DRIVE UNIT FOR AUTOMOBILE WINDOWS

CROSS-REFERENCE TO RELATED APPLICATIONS

Figure 1:
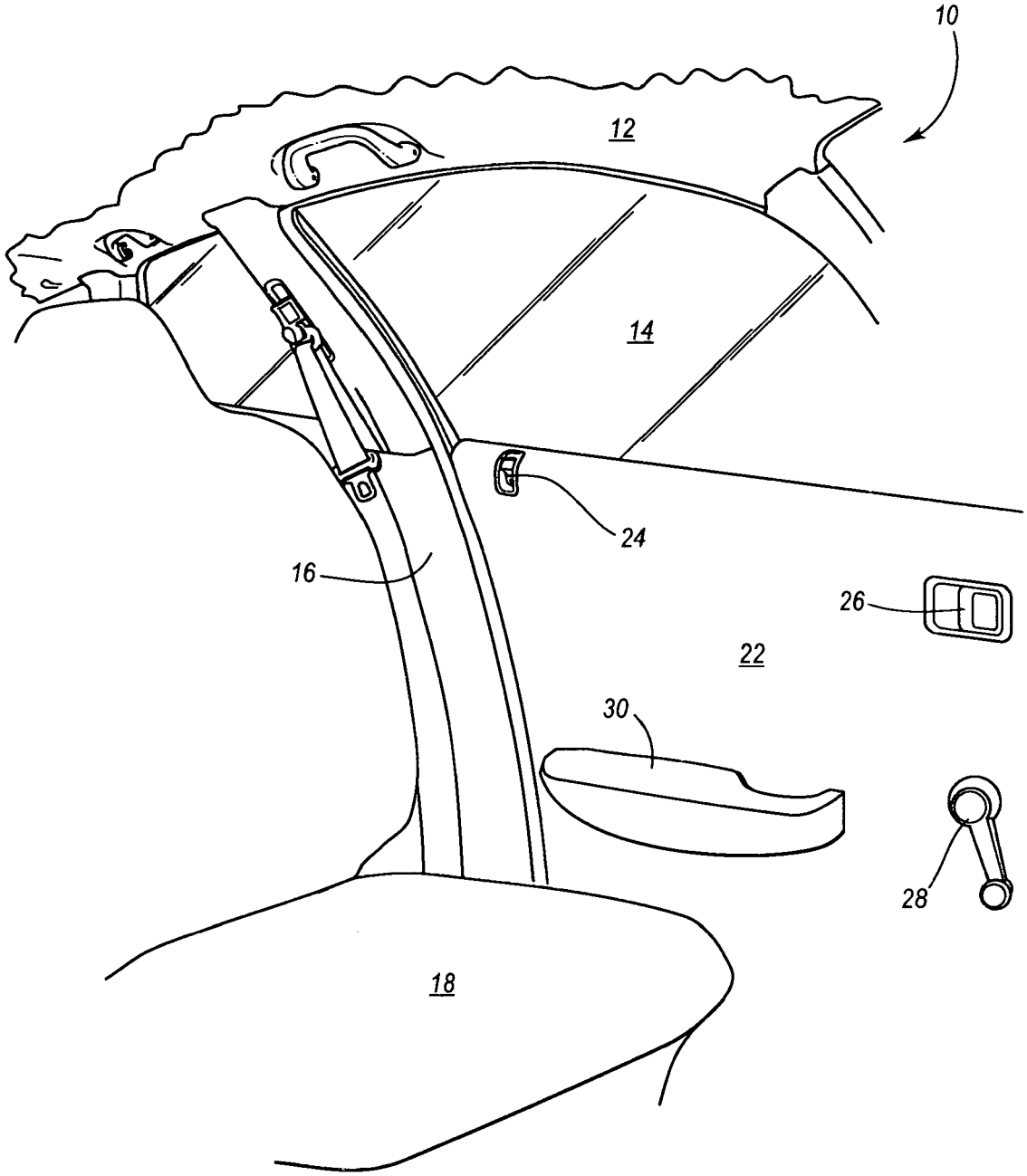
Fig. 1 (Prior Art)

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Field of the Invention

This invention relates to powered operation of side windows in automobiles. The use of powered vehicle window operations has become increasingly popular, largely because to operate a window by merely pushing a button allows an operator to maintain better attention to driving than can be achieved if the operator must perform a cranking function, often while driving a vehicle. Nevertheless, because of the increased cost of vehicles having factory installed powered window systems, many vehicles are still sold with simple crank systems for raising and lowering side windows. The need for powered windows becomes even more apparent to operators of what are often identified as full size pick-up trucks. Full sized wider bodied vehicles, such as full size pick-up trucks, are so wide that an operator cannot easily reach across a passenger side to manually operate a passenger side window even though there may be a need for such operation. Certainly, it is not safe to operate a window crank on a passenger side of a vehicle while the vehicle is traveling.

2. Prior Art

At the present time, many automobiles include factory installed power driven side windows. Such windows are generally controlled both at a driver's location and at the location of the window being operated.

The addition of such factory installed powered window drive systems generally come only at a significant increased sales price for the vehicle.

Because of the expense involved in having factory installed powered windows, many people continue to purchase new vehicles without such powered windows. Also, at the present time, there are a large number of older vehicles, in use, that do not have powered windows. It has been found that the owners of many vehicles, not factory equipped with power windows, and particularly in wider bodied vehicles such as full size pick-up trucks, there is a need to convert the windows that are not factory powered to operate in the same manner as the factory installed power windows. It is also desirable that a conversion unit to modify the manual crank operated windows to be power driven must be low in cost and easily installed as an add-on unit to the vehicle.

BRIEF SUMMARY OF THE INVENTION

Objects of the Invention

Principal objects of the present invention are to provide a power driven unit for automobile windows that is easily installed and that will convert a standard hand crank operated vehicle side window that raises and lowers within a door structure, to be a powered window.

Another object is are to provide such a conversion unit that is economically produced so as to be marketed at a price lower than the charge normally associated with factory installed powered windows.

It is another object to provide a conversion unit for connecting standard hand crank driven automobile windows to be powered by an electric motor.

Other objects are to provide a power conversion unit that is compact, attractive and easily connected to a window to be power driven.

Features of the Invention

Principal features of the invention include a housing for a power drive unit that is readily secured to the inner panel of a door having a window to be converted from a manual crank operated window to an electrically powered window.

Another feature is to provide a housing that is thin and that includes a decorative front face spaced by a decorative peripheral wall from a flat rear door panel engaging panel.

The housing has a reversible electric motor therein and a ring gear that is driven by the motor through connecting gears.

At least one control switch is mounted on the housing to control operation of the reversible motor. Electrical wires for the motor and each switch provided for additional power drive units to be controlled both at a driver's site and at the site of the other power drive unit pass through the rear face.

A splined shaft is driven by the reversible motor and is accessible through an opening in the rear face of the housing. An adapter coupler having interiorly splined, aligned ends, has one end to fit onto the splined shaft driven by the reversible motor and an opposite internally splined end to fit onto a splined shaft that is connected to a window to be powered. Thus, the adapter connector serves to couple the reversible drive motor to the window.

The power drive unit of the invention is attached to an inner panel of a vehicle door having a window to be power driven by screws inserted through the housing and into the door. The screws may thread into the inside door panel and preferably will pass through the inside door panel to be threaded into bracing member located between the inside door panel and the outside of the door.

A single power drive unit of the invention may be provided on a single vehicle door to drive a window that raises and lowers out of and into the door. The control switch for operating the reversible motor of the drive unit is preferably located on the housing of the power unit.

More than one drive unit can be used with a single vehicle. Thus, if drive units are provided on both a driver's door and a passenger door to power windows out of and into both doors, the power unit on the driver's side door will have a pair of control switches on the housing thereof. One switch serves as a separate actuator for operating the reversible motor of the power driven unit affixed to the passenger door. With this arrangement, a driver can control operation of either side window and a passenger can control operation of the window in the passenger door.

Additional objects and features of the invention will become apparent to persons skilled in the art to which the invention pertains from the following detailed description and claims.

BRIEF DESCRIPTION OF THE FIGURES OF THE INVENTION

In the Drawings

Figure 2:
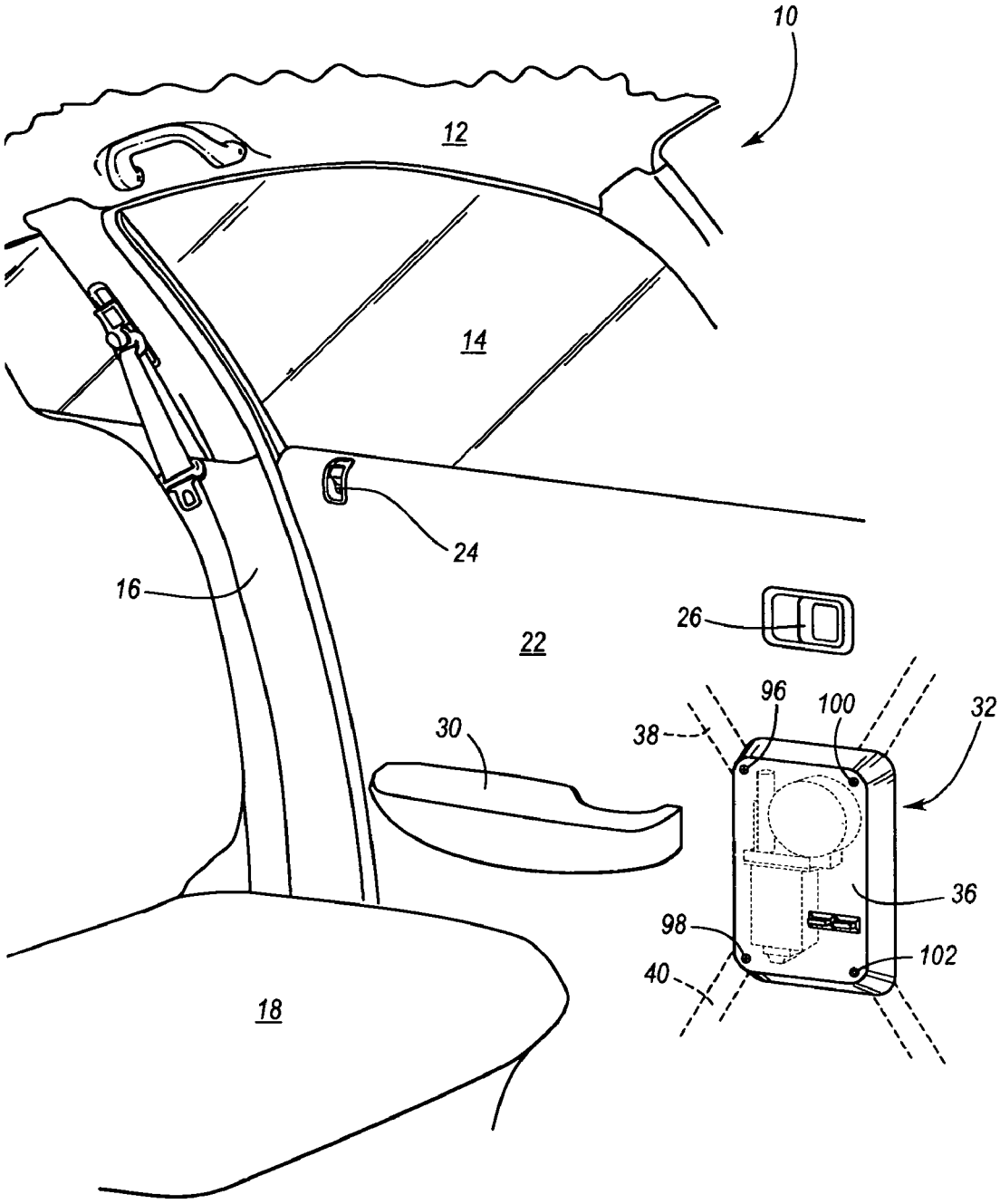
Figure 3:
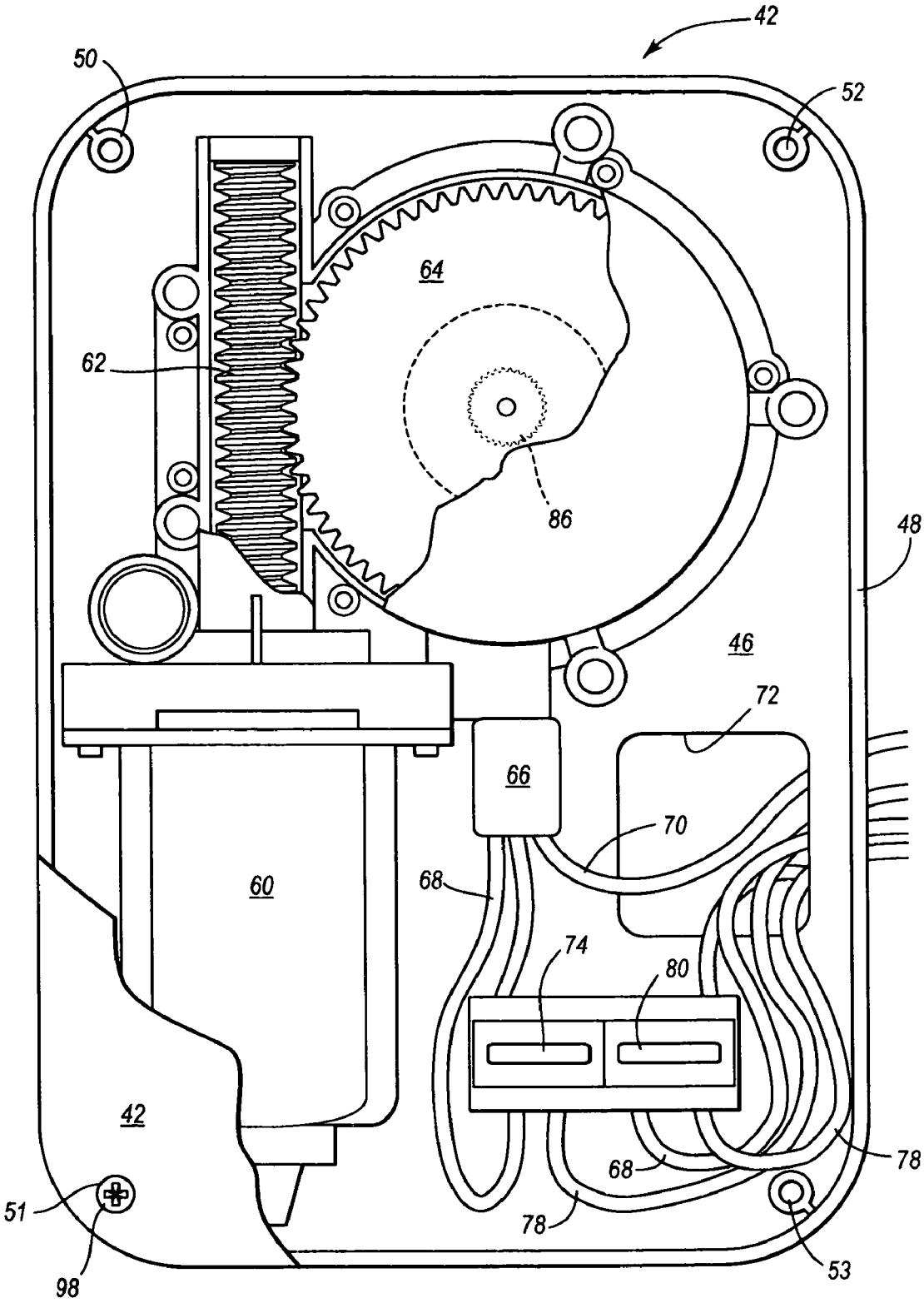
Figure 4:
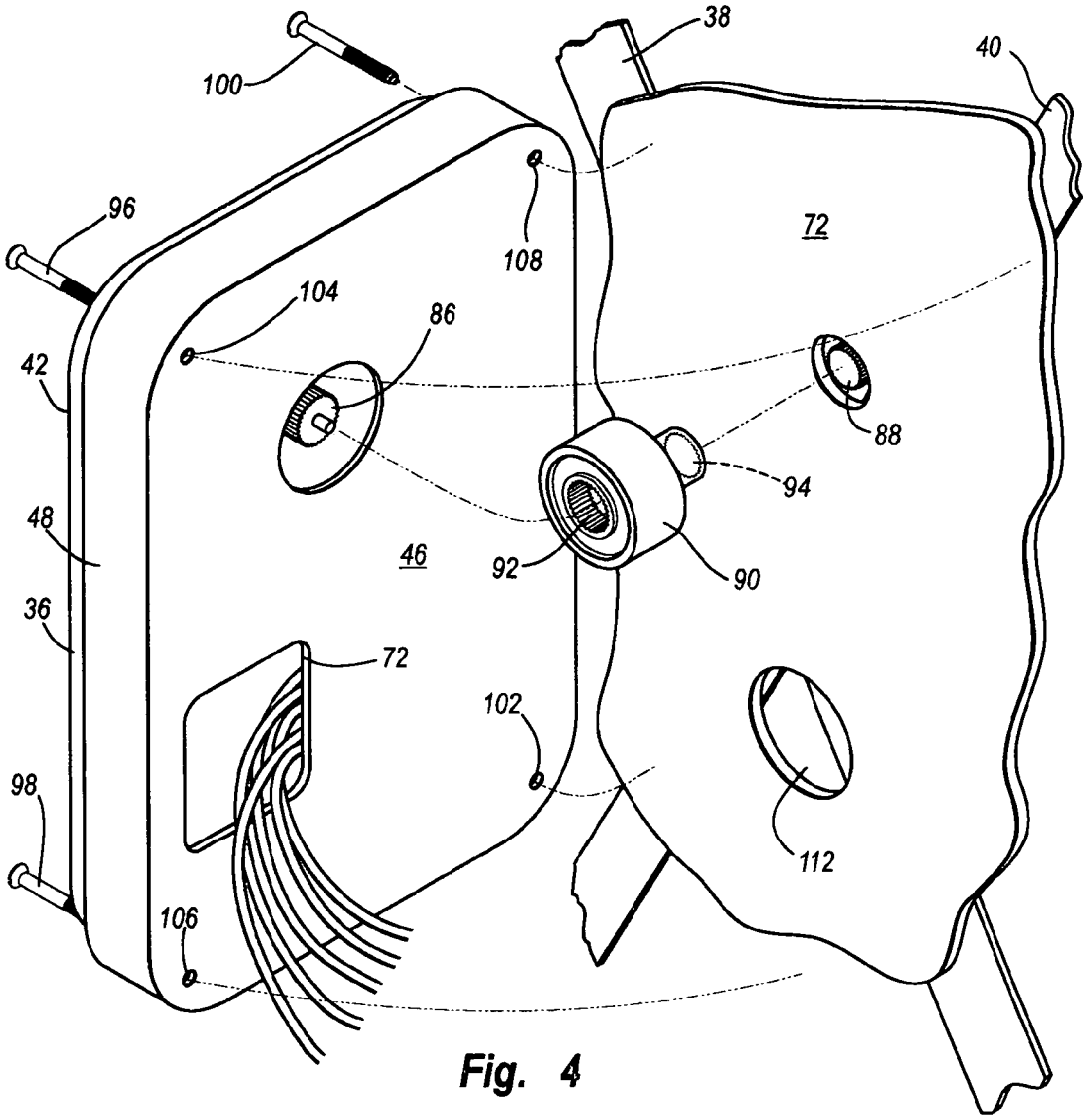
Figure 5A:
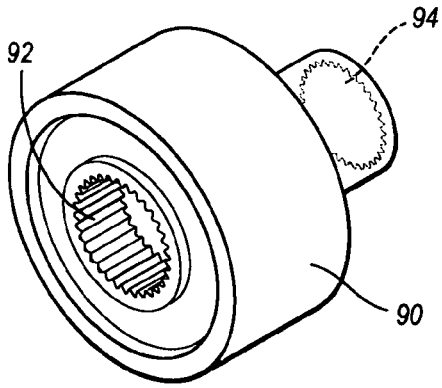
Figure 5B:
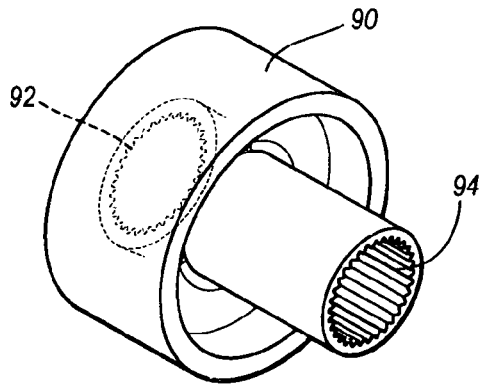

FIG. 1 is a fragmentary perspective view of a conventional, prior art, interior of a vehicle, showing a vehicle door, window and a crank handle for lowering and raising the window through conventional mechanisms;

FIG. 2, a view like that of FIG. 1, but with the crank handle replaced by the power drive unit of the invention;

FIG. 3, a plan view of the interior of the power unit of the invention;

FIG. 4, an exploded perspective view of the power unit of the invention and showing the coupling of the power unit to a splined shaft of the window that is movable out of and into the vehicle door;

FIGS. 5*a* and 5*b*, a perspective view of the coupler used to connect the power unit to the window, and taken from each end of the coupler; and FIG. 5B, a view like that of FIG. 5A, taken from the opposite end of the coupler.

DETAILED DESCRIPTION

Referring now the Drawings

In FIG. 1, there is shown a typical vehicle 10 having the usual roof 12, a side window 14, and a support post 16 of the vehicle frame that supports the roof and serves as a door stop.

A driver's seat 18 is positioned adjacent to the interior panel door 22. The door 22 has a door lock 24 and a door latch 26 mounted therein, a conventional window operating crank 28 and an armrest 30.

As shown in FIG. 2, all components shown in FIG. 1, remain unchanged, except for the window operating crank 28 that is removed so that the power drive unit of the invention, shown generally at 32, can be added in place of the crank.

Power drive unit 32 includes a housing 36 that mounts to the interior door panel 22 and bracing members 38 and 40 inside the door, as will be further described.

Housing 36 includes a front face plate 42 and a rear plate 46 that will be flat against the interior panel 22 of the door and has a window drive mechanism attached thereto. A peripheral wall 48 is fixed to and projects from the rear plate 46 to surround the rear face plate and to receive the decorative front face plate 42 there against. The wall 48 and front face plate 42 both have a decorative outer finish that will not detract from the interior appearance of the vehicle.

Spacers 50, 51, 52 and 53 are provided in corners of rear plate 46 and serve as screw guides.

A reversible electric (dc) motor 60 is mounted to rear plate 46 and motor 60 drives a worm gear 62. Worm gear 62 meshes with a ring gear 64 that is mounted for rotation on rear plate 46.

An electrical control panel 66 of motor 60 connects electric wires 68 and 70 to the motor. The wires pass through an opening 72 in the rear plate 46. Wire 68 is connected through a conventional rocker switch 74 that maintains a biased "OFF", centered position. The switch will connect the wires 68 and 70 with wire 78 when the switch 74 is rocked forward or back to drive motor 60 in a forward or a reverse direction. Switch 74 projects through front panel 42 when the front panel is installed or may be mounted to project through the peripheral wall 48.

An additional switch 80 may also be provided, together with wires to operate a second power unit arranged to drive a second window (not shown) of the vehicle. This arrangement will allow a driver to control windows on both sides of a vehicle from the driver's location. Such an arrangement is particularly useful in wide body vehicles where it is difficult for a driver to reach across the vehicle to operate a passenger side window.

All electrical wires, whether used to power one power unit or two power units, are passed through the interior of the vehicle door and out the door at a hinge, to be connected to the electrical circuit of the vehicle.

The power unit 32 of the invention is connected to the window to be driven by a coupler 90 having a splined bore 92 at one side and a splined bore 94 at an opposite side. Splined bore 92 is mated with the splined output shaft 86 connected to the ring gear 64. The splined bore 94 is then fitted over and is mated with the splined shaft 88 from which crank handle 28 has been removed.

Power unit 32 is affixed to the interior panel 22 of the door by self-tapping screws 96, 98, 100 and 102, inserted through the front face plate 42, and the screw guides 50, 51, 52 and 53 and into the interior door panel 22 and the cross-bracing 38 and/or 40. Once the power unit is positioned and connected electrically, the window 14 is powered up or down by actuation of switch 74.

All electrical wires to the switches 74 and 80 pass through opening 72 in the rear panel and opening 112 cut through the interior door panel 72.

Although a preferred embodiment of my invention has been herein described, it is to be understood that the present disclosure is by way of example and that variations are possible without departing from the subject matter coming within the scope of the following claims, which subject matter I regard as my invention.

I claim:

1. A power in combination with anexisting drive unit of a vechicle, said power unit comprising a vehicle window a housing comprising a rear panel, a raised wall extending around a peripheral edge of said rear panel and a front panel, said raised wall and said front panel having decorative exterior surfaces;

a drive means carried by said rear panel, said drive means including a reversible electric motor having an output shaft and gear means coupling said output shaft to the vehicle window;

a secure means to secure said rear panel against an interior surface of a vehicle interior door panel with said drive means coupled to said drive unit;

control switch means projecting through said housing; and means for electric wires connected to the reversible motor to pass through said rear panel and through the interior door panel.

2. A power unit as in claim 1, wherein said secure means to secure the rear panel against said vehicle interior door panel comprises screws through the front panel, the interior of the housing, the rear panel and adapted to be screwed into said interior door panel.

3. A power unit as in claim 1, wherein the drive means further includes a worm gear driven by the motor; and a ring gear driven by said worm gear having a central shaft turned by said ring gear and coupled to a rotatable shaft connected to said window.

4. A power unit as in claim 2, wherein the drive means further includes a worm gear driven by the motor; and a ring gear driven by said worm gear having a central shaft turned by said ring gear and coupled to a rotatable shaft connected to said window.

5. A power unit as in claim 4, further including a second control switch means projecting through said housing to operate a second power unit on a second door of the vehicle.

* * * * *